United States Patent [19]

Simon

[11] 4,437,670

[45] Mar. 20, 1984

[54] CARD GAME

[76] Inventor: Lillian D. Simon, 2000 S. Eads St., Arlington, Va. 22202

[21] Appl. No.: 452,794

[22] Filed: Dec. 23, 1982

Related U.S. Application Data

[63] Continuation of Ser. No. 268,578, May 29, 1981, abandoned.

[51] Int. Cl.[3] ..... A63F 1/04

[52] U.S. Cl. ..... 273/296; 273/297; 273/278

[58] Field of Search ..... 273/292, 296, 297, 303, 273/304, 278

[56] References Cited

U.S. PATENT DOCUMENTS

| | | | |
|---|---|---|---|
| 1,516,798 | 11/1924 | Striker | 273/297 |
| 2,042,930 | 6/1936 | Emmerich | 273/296 |
| 2,154,891 | 4/1939 | Dodge | 273/302 X |

FOREIGN PATENT DOCUMENTS

| | | | |
|---|---|---|---|
| 517108 | 1/1940 | United Kingdom | 273/278 |

*Primary Examiner*—Anton O. Oechsle

*Attorney, Agent, or Firm*—Anthony A. O'Brien

[57] ABSTRACT

A card game for a plurality of players includes two decks of cards having identical playing surfaces and visually distinguishable decorative non-playing back surfaces. The game also includes game tokens and game token containers. In setting the game up, one card from a first of the two decks is placed under each of the game token containers. As one of the players serves as a broker the cards from a second of the two decks are auctioned off, one at a time, to the highest bidder from among the players. The proceeds from the auction are placed in the containers. After all the cards from the second deck have been auctioned off the broker recalls the cards one a time using the first of the two decks which has a set of playing surfaces identical to those in the second deck. During the recall the broker opens the game to a trading session during which the players buy, sell and trade their remaining cards among themselves. The winners are the holders of the cards from the second deck which correspond to the cards under the containers, and those players receive the tokens in the respective containers.

2 Claims, 5 Drawing Figures

CARD GAME

This application is a continuation of application Ser. No. 268,578 filed May 29, 1981, now abandoned.

BACKGROUND OF THE INVENTION

1. Field of the Invention

The invention relates to card games and particularly to a card game for five or more players wherein two decks of cards having investment opportunities illustrated on the playing surfaces thereof are bought, sold and traded among the players.

2. Description of the Prior Art

The prior art as exemplified in U.S. Pat. No. 4,071,247, No. 4,179,128 and No. 4,192,513 contains several card games and board games utilizing cards.

SUMMARY OF THE INVENTION

The invention is summarized in a card game for a plurality of players including a first deck of cards having a first decorative back surface, the first deck having a different investment opportunity depicted on a playing surface of each card, a second deck of cards having the same number of cards as the first deck and having a second decorative back surface visually distinguishable from the first back surface, the second deck having an investment opportunity depicted on a playing surface of each card in one-to-one correspondence with the investment opportunities depicted on each card in the the first deck, a plurality of game tokens, a plurality of game token containers for holding the game tokens to be received by a winner of the game, one of the cards from the first deck being placed under each of the game token containers at an initial point in the game to serve as the winning cards, and, wherein one of the players serves as a broker and auctions off the cards from the second deck for game tokens to a highest bidder among the players who then receives the card bid upon and places the tokens expended in the successful bid in one of the game token containers, the auctioning continuing until all of the cards in the second deck are controlled by the players, the broker then commences with a recalling of the cards from the second deck by turning face up the cards from the first deck one at a time and demanding the player holding the card from the second deck which is identical to the upturned card of the first deck to surrender that card to the broker who places both cards in a discard pile, the recall continues until all the cards from the second deck have been recalled except for the cards which correspond to the winning cards from the first deck which are under the game token containers, during the recall period the broker declares that the game is open for trading which allows the players to trade, buy and sell cards among themselves in order to try and obtain the cards which correspond to the winning cards, after the recall is completed the players holding the winning cards receive the tokens in the container corresponding to the cards they hold, a winner in the game being the person with the most tokens.

It is accordingly an object of this invention to provide a card game which can be enjoyed by players of all ages and which is easily learned and understood.

It is a further object of the invention to provide a card game in which the level of strategy used by the players is controllable during the game so that children playing the game are at no disadvantage.

These as well as other objects and advantages of the invention will be apparent from the following description when taken in conjunction with the accompanying drawings.

DESCRIPTION OF THE PREFERRED EMBODIMENTS

Figure 1:
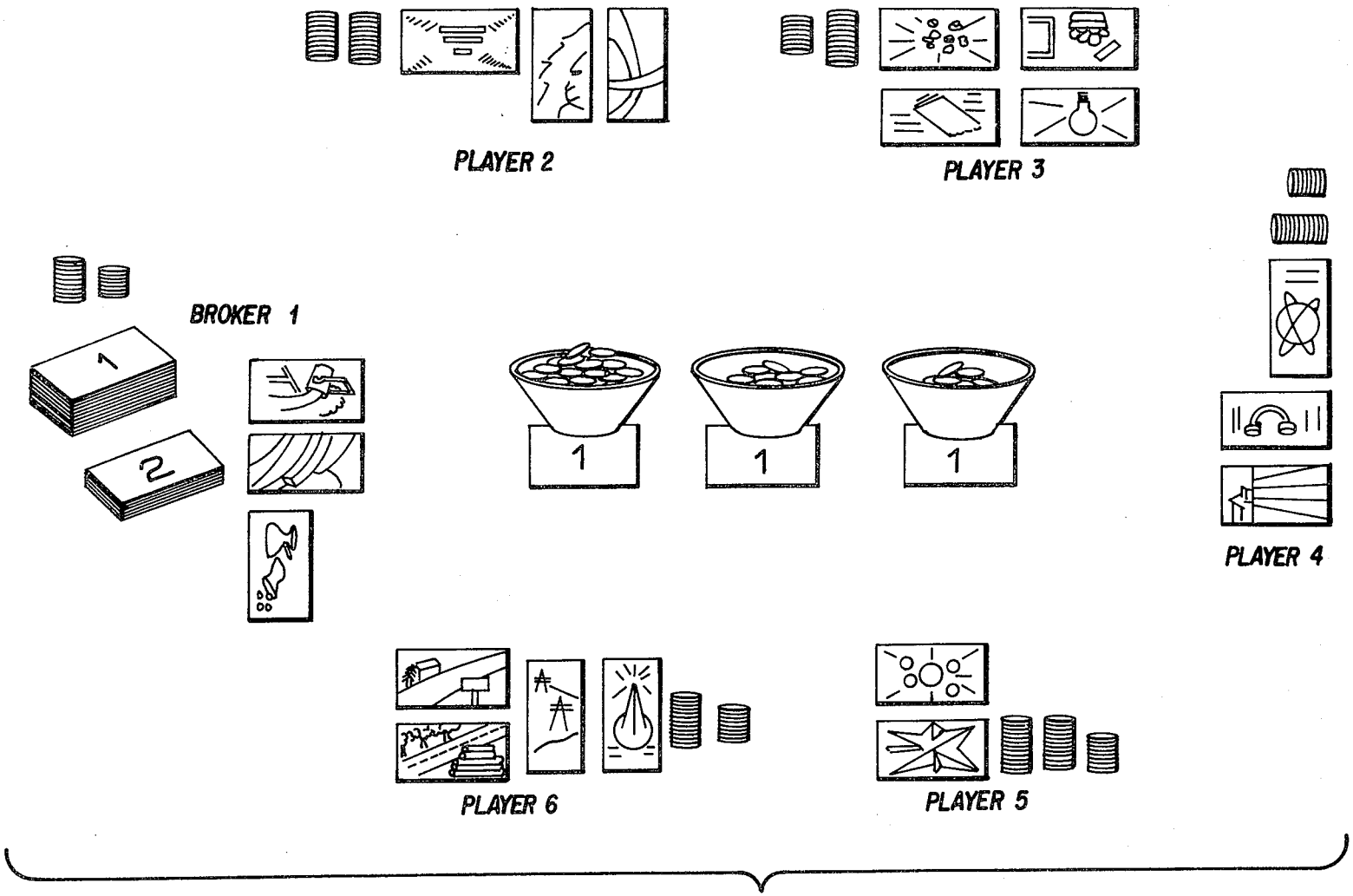
FIG. 1 is a diagrammatic perspective view of a card game in progress in accordance with the invention.

Referring now to the drawings, the present invention is embodied in a card game adapted for play by five or more players as best shown in FIG. 1 at an early point in the game. In the preferred embodiment the game includes two decks of cards, deck #1 and deck #2, three game token containers, and a plurality of game tokens. The game token containers are represented in FIG. 1 as circular dishes, although any type of receptacle would suffice. The term "tokens" as used herein is defined as to include any suitable objects which can have an individual value attached thereto, such as poker chips, coins, play money, etc. Deck #1 contains forty cards having identical back surfaces, as represented in FIG. 1 by diagonal lines with a numeral 1 in the center, although any decorative design would suffice. A different investment opportunity is depicted on the playing surface of each of the cards in deck #1. A list of forty of the possible investment opportunities is listed below in table 1.

TABLE 1

1. STEEL
2. GOLD
3. DIAMONDS
4. RAILROADS
5. LAND DEVELOPMENT
6. OIL
7. PHOTOGRAPHIC INDUSTRY
8. LUMBER
9. PUBLISHING INDUSTRY
10. TOBACCO
11. TELECOMMUNICATIONS
12. RACE HORSES
13. COAL
14. CHAIN GROCERY STORES
15. AIR LINES
16. ELECTRIC POWER
17. OFFICE EQUIPMENT
18. ANTIQUE CARS
19. AUTOMOBILE INDUSTRY
20. ELECTRONIC COMPUTER CHIPS
21. SILVER
22. TRUCKING INDUSTRY
23. WINE INDUSTRY
24. NUCLEAR ENERGY
25. COSMETIC INDUSTRY
26. HOTELS
27. FOOTBALL LEAGUES
28. VACATION COTTAGE
29. CHEMICALS
30. SOLAR ENERGY
31. TELEVISION
32. MOTION PICTURES
33. CATTLE RANCHES
34. REAL ESTATE
35. TOY INDUSTRY

TABLE 1-continued

| |
|---|
| 36. SHIPPING |
| 37. FASHION INDUSTRY |
| 38. FAST FOOD RESTAURANTS |
| 39. MUSIC RECORDING INDUSTRY |
| 40. ELECTRICAL APPLIANCES |

Figure 5:
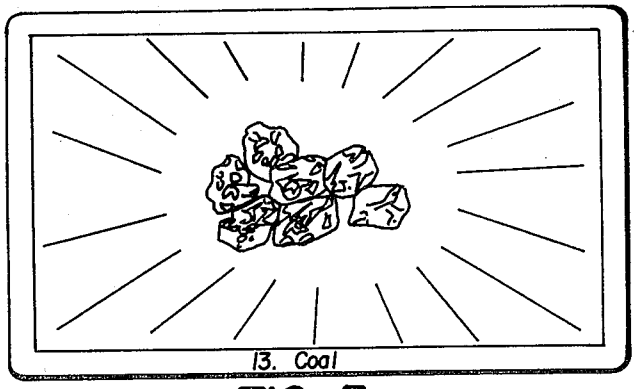
FIG. 5 is a playing surface of card #13 illustrating an investment opportunity of COAL.
Figure 2:
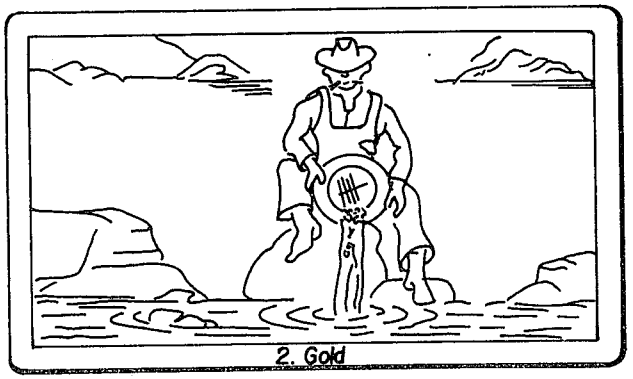
FIG. 2 is a playing surface of card #2 illustrating an investment opportunity of GOLD.
Figure 4:
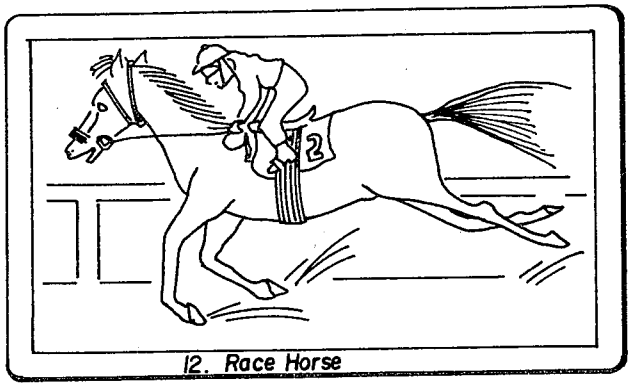
FIG. 4 is a playing surface of card #4 illustrating an investment opportunity of a RACE HORSE.
Figure 3:
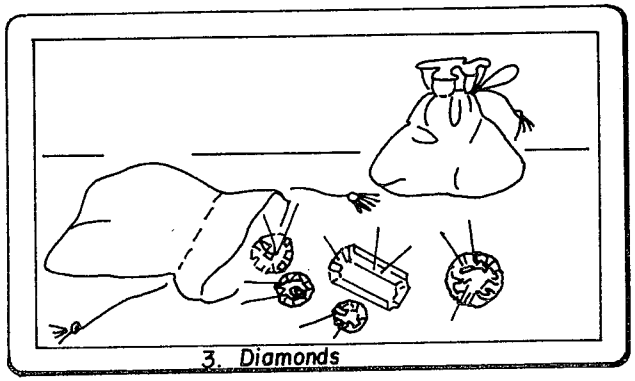
FIG. 3 is a playing surface of card #3 illustrating an investment opportunity of DIAMONDS.

It will be understood that this list exemplifies only some of the multitude of possible investment opportunities which could be used in accordance with the invention. FIGS. 2-5 show illustrated depictions of four of the forty investment opportunities which appear on the playing surfaces of the cards. FIG. 2 shows a man panning for gold and is numbered as card number 2, which corresponds to a GOLD being number 2 on the list of investment opportunities in table 1. Likewise, FIG. 3 depicts DIAMONDS and is numbered 3, FIG. 4 depicts a RACE HORSE numbered 12 and FIG. 5 shows COAL numbered 13, all the numbers corresponding to the list of investment opportunities in table 1. It should be understood that the illustration of each of the investment opportunities on the cards lends color and added interest to the playing of the game, however, if for economic or other reasons the illustrations are not desirable, they may be replaced by simple printing of one of the opportunities in the list of table 1 on the playing surface of each of the cards in the deck.

Deck #2 also contains forty cards and is identical to deck #1 except that the back surface is distinguishable, shown in FIG. 1 as diagonal lines with a numeral 2 in the center. The playing surface of each of the cards in deck #2 is identical to a corresponding one of the cards in deck #1 so that the decks are identical except for the decorative back surfaces which can be of contrasting color and/or of different designs.

In the preferred embodiment the two decks are the size of conventional playing cards and the investment opportunities are illustrated in multicolor. The decks could either be packaged with the game tokens and containers or boxed alone, leaving it to the buyer to supply suitable tokens and containers.

The card game in accordance with the present invention is played as follows: The players select one person from among themselves to serve as a broker. This broker will be in charge of the shuffling, dealing, and auctioning of the cards and will control the various other facets of the game, however, the broker will still be an active player in the game. For the purposes of illustration, it will be assumed that, as shown in FIG. 1, there are six players in the game and player 1 has been selected as the broker. The game tokens are now distributed by the broker among the players. Alternatively, as in the case of using coins, the players will use their own coins as tokens. After shuffling the decks, the broker sets deck #2 aside for the moment and spreads deck #1 out in front of the players with the playing surface down. The broker then arbitrarily picks three of the players and asks them to each touch a card. The three cards thus touched by the players are then placed, still face down, one under each of the containers. As will be described more fully hereinafter, these cards are the winning cards. Deck #1 is now set aside until later in the game. It is essential to the playing of the game that deck #1 is set aside at this point because, as will become clear, deck #1, from which the winning cards have been removed will be used later in the game to determine the winners.

After the winning cards have been placed under the containers, the broker deals a few cards face up from deck #2 to each player, including himself, for which the players must pay a small number of tokens. For example, if the broker declares that each player is to receive two initial cards at a cost of three tokens per card, then each player would have to pay six tokens to the pot, the pot being the three containers. It doesn't matter which of the three containers a player puts his tokens owed into since later in the game the tokens in the containers will be redistributed among the three containers in a manner prescribed by the broker and a majority of the players. It is important that the broker make the price of the initial cards reasonable to insure that the more timid players will not have to expend many of their tokens.

As the players receive their cards they are placed face up in front of them. The broker now proceeds to auction off the remainder of the cards in deck #2. This auctioning may be done in several ways, the preferred way being that the broker places deck #2 in front of him face down and takes a card off the top of the deck and holds it in front of the players while calling out the title of the investment. He can auction the cards singly or in groups of two or more to the highest bidder. The bidding by the players on each of the card or cards being auctioned continues until one player is the highest bidder. While a player may want to accumulate as many cards as possible, care must be taken not to use all of his tokens too quickly because they will be needed later in the game. As a strategy consideration, to be more fully understood hereinafter, some players may want to purchase as many cards as possible in the hope of having a strong bargaining position later in the game. Conversely, other players may want to just keep their original cards which were obtained at bargain prices. This is exemplified in FIG. 1 at an early stage of the auction where Player 6 holds four cards while Player 5 holds only the two original bargain priced cards. If both adults and children are playing in the game, the auctioneer may want to abruptly stop the bidding when one of the children has the high bid in order that the children can take a more active role in the game. As the players buy the cards, the proceeds from the sale to the highest bidder are placed in any of the game token containers. As the players become more familiar with the game they will develop a strategy with regard to how many cards they wish to hold after the auctioning is completed and which cards they wish to bid on. They may even wish to bid only on cards portraying certain investment opportunities. The players must take care not to use their tokens frivolously since, as will become clear, the person holding the most tokens at the end of the game is the winner.

After all the cards from deck #2 are sold and the auction is completed, the tokens accumulated in the three containers during the auction can be distributed among the containers such that the first container has the greatest amount, the second container has a lesser amount, and the third container the least amount. Alternatively, the amount of tokens in each of the three containers can be left as it is after the auction or the tokens could be distributed such that an equal amount of tokens are in each container.

The broker now returns to deck #1, from which the winning cards have previously been removed, and proceeds with a recall of the cards from deck #2. This is done by taking a card from deck #1 and holding it face up in front of him for the players to see, and calling out the investment opportunity on the card. The player holding the corresponding card from deck #2 which matches the recall card from deck #1 must surrender that card to the broker without compensation to the player. The broker then takes the two matching cards and places them in a discard pile. As a practical matter, the broker should place the cards in separate discard piles, one pile for deck #1 and one pile for deck #2, so that at the end of the game the two decks are separated and can be simply shuffled and the game started again. As the recall continues, the players will have fewer and fewer cards and some of the players may have no cards. So that the players with no cards remaining are not out of the game, the auctioneer can declare the market open for a trading session. During the trading session the players deal among themselves in any way they like. Some of the options include buying cards from one another, trading cards, buying a partial interest in a card or two players agreeing to share a half-interest in each others cards. After all the trades have been made the broker closes the trading session and begins again to recall cards. During the recall no trading among the players is allowed, however, the auctioneer has the option of reopening the trading session any time he feels that there will be trades made. As the game nears the end and there are only a few cards left to be recalled, the trading will become more hectic as the players try to get control of the cards from deck #2 which correspond to the winning cards under the containers. The persons holding the cards from deck #2 which correspond to the winning cards from deck #1 which were placed under each of the containers at the beginning of the game win the tokens in that container when the recall is completed. If two players have a share in one of the winning cards, then the players split the tokens from the corresponding container. The winner or winners of the game is the player or players having the most tokens at the end.

In an alternative embodiment, each of the decks contains three additional cards which serve as bonus or maverick cards. Again, each of the three new cards in deck #1 is identical to a corresponding one of the new cards in deck #2. These additional cards would be merged into each of the decks respectively and the game would be played in the same manner as set forth above. With the three additional cards being merged into deck #1, one or more of them could be chosen as winning cards at the beginning of the game and placed under the containers. As will be seen, these maverick cards will add additional excitement to the game in the event that one of them happens to be placed under one of the containers. An example of three possible maverick cards is shown in table 2.

TABLE 2

| |
|---|
| 41. BROKERAGE FEE |
| 42. TAX PAYMENT |
| 43. INVESTMENT DIVIDEND |

The playing surfaces of these cards will have the title of the card printed thereon along with a printed explanation of the effect of the card. For example, the BROKERAGE FEE card would contain a statement requiring the player to pay 10% of his winnings to the broker. Likewise, the TAX PAYMENT card would allow the holder of the card to collect a 10% tax on the winnings of the other two winners. Along the same lines, the INVESTMENT DIVIDEND card would allow the player to collect a dividend of an additional 10% of his winnings from the broker. In the event that one of the maverick cards is a winning card, the player having that card must follow the instructions on that card.

The players must be shrewd in their buying, selling and trading in order to optimize their chances of winning. It should be realized that by intelligent playing and a little luck, a player could win even without holding one of the winning cards. This could be done by a player buying as many cards as possible during the auction so that he would have cards remaining when some of the other players have none thus increasing his bargaining power during the trading session.

Many alternative arrangements of the above described preferred embodiment are possible without departing from the scope of the invention. For instance, the number of cards in the decks could be increased or decreased without changing the way the game is played. Similarly, there could be more or fewer maverick cards and game token containers. Further, the game is not limited to an investment opportunity theme and could just as well be oriented towards a flea market sale, commodities at a county fair or furnishings sold at an auction house. The list of possible themes which could be used within the scope of the invention is virtually limitless.

Since many modifications, variations and changes in detail may be made to the described embodiments, it is intended that all matter in the foregoing description and shown in the drawings be interpreted as illustrative and not in a limiting sense.

What is claimed is:

1. A card game for a plurality of players comprising
a first deck of cards including forty three cards,
a first decorative back surface on each of the first deck of cards,
a different playing surface on each of the first deck of cards,
an investment opportunity depicted on the playing surface of each of forty of said first deck of cards with a different opportunity shown on each card,
a second deck of cards having the same number of cards as the first deck of cards,
a second decorative back surface on each of the second deck of cards different from the first decorative back surface so that the first and second decks of cards are distinguishable from each other,
a different playing surface on each of the second deck of cards,
an investment opportunity depicted on the playing surface of each of forty said second deck of cards with a different opportunity shown on each card and being in one-to-one correspondence with the playing surface on each of the forty cards in said first deck of cards whereby the playing surfaces of the forty cards in said second deck of cards are identical to the playing surfaces of the forty cards in said first deck of cards,
three of the first deck of cards and a corresponding three of the second deck of cards are maverick cards with three different maverick opportunites depicted on the respective playing surfaces thereof,
a plurality of game tokens being of equal value and being equally distributed among the plurality of players,
a plurality of containers for holding game tokens,
a plurality of game winning cards randomly selected from said first deck of cards at an initial point in the game and being placed, with playing surfaces down, under the plurality of containers with one winning card for each container, a broker selected from among the players, an auction session conducted by the broker to auction the forty-three cards in said second deck to the players in response to highest bids paid by the tokens of the player who made the highest bid, said paid tokens being randomly placed in the containers, a selling session among the players wherein the cards of said second deck may be purchased for said tokens, a trading session wherein the cards of said second deck may be traded among the players, a recall session wherein the broker uses the first deck of cards from which the winning cards were initially removed to recall one by one the corresponding cards of the second deck until all of the second deck cards are surrendered except the winning cards, and the winning cards under the token containers being exposed face up to be matched with corresponding cards held by the players who receive the tokens in such containers whereupon a game winner is indicated by the player amassing the most tokens.

2. A card game as claimed in claim 1 wherein the investment opportunities depicted on the playing surface of forty cards in each deck include steel, gold, diamonds, railroads, land development, oil, photographic industry, lumber, publishing industry, tobacco, telecommunications, race horses, coal, grocery stores, airlines, electric power, office equipment, antique cars, automobile industry, electronic computer chips, silver, trucking industry, wine industry, nuclear energy, cosmetic industry, hotels, football leagues, vacation cottage, chemicals, solar energy, television, motion pictures, cattle ranches, real estate, toy industry, shipping, fashion industry, fast food restaurants, music recording industry, and electrical appliances, and wherein the maverick opportunities depicted on the playing surfaces of three cards in each deck include an investment dividend, a brokerage fee and a tax payment.

* * * * *